US007008915B2

(12) United States Patent
Aouad et al.

(10) Patent No.: US 7,008,915 B2
(45) **Date of Patent: *Mar. 7, 2006**

(54) LIQUID DETERGENT COMPOSITIONS WITH LOW-DENSITY PARTICLES

(75) Inventors: Yousef Georges Aouad, Cincinnati, OH (US); Christopher John Lienhart, Cincinnati, OH (US); Diane Parry, Cincinnati, OH (US)

(73) Assignee: The Procter & Gamble Co., Cincinnati, OH (US)

( * ) Notice: Subject to any disclaimer, the term of this patent is extended or adjusted under 35 U.S.C. 154(b) by 69 days.

This patent is subject to a terminal disclaimer.

(21) Appl. No.: 10/198,195

(22) Filed: Jul. 17, 2002

(65) Prior Publication Data

US 2003/0109397 A1 Jun. 12, 2003

Related U.S. Application Data

(63) Continuation-in-part of application No. 10/048,698, filed on Aug. 8, 2000.

(60) Provisional application No. 60/310,594, filed on Aug. 7, 2001.

(51) Int. Cl.
*C11D 17/00* (2006.01)

(52) U.S. Cl. ..... 510/445; 510/446; 510/451; 510/452; 510/456; 510/457

(58) Field of Classification Search ..... 510/445, 510/446, 451, 452, 456, 457
See application file for complete search history.

(56) References Cited

U.S. PATENT DOCUMENTS

| | | | |
|---|---|---|---|
| 4,615,820 | A | 10/1986 | Hepworth et al. |
| 4,828,723 | A | 5/1989 | Cao et al. |
| 4,889,652 | A | 12/1989 | Sullivan et al. |
| 4,929,380 | A | 5/1990 | Schulz et al. |
| 5,008,031 | A | 4/1991 | Schulz et al. |
| 5,176,173 | A | 1/1993 | McGarrah |
| 5,589,370 | A | 12/1996 | Ratuiste et al. |

FOREIGN PATENT DOCUMENTS

| | | |
|---|---|---|
| EP | 030096 | 6/1981 |
| EP | 565017 | 10/1993 |
| WO | WO 92/09678 | 6/1992 |
| WO | WO 01 11002 | 2/2001 |
| WO | WO 01 11003 | 2/2001 |

*Primary Examiner*—Necholus Ogden
(74) *Attorney, Agent, or Firm*—Kim W. Zerby; Steven W. Miller

(57) ABSTRACT

Process for reducing the density of solid detergent ingredients by forming said ingredients into hollow-core particles. The density of ingredients such as sodium citrate, sodium carbonate and/or sodium silicate, when formed into such hollow-core particles, allows them to be stably incorporated into non-aqueous liquid laundry detergents.

11 Claims, No Drawings

LIQUID DETERGENT COMPOSITIONS WITH LOW-DENSITY PARTICLES

CROSS-REFERENCE TO RELATED APPLICATION

This application is a continuation-in-part of U.S. application Ser. No. 10/048,698, filed Aug. 8, 2000 based on International Application PCT/US00/21572, filed 8 Aug. 2000, corresponding to WO 01/11003A1, published 15 Feb. 2001, and also claims priority from Provisional Application Ser. No. 60/310,594, filed Aug. 7, 2001.

FIELD OF THE INVENTION

The present invention relates to liquid laundry detergent compositions that comprise suspended solid particles, wherein the liquid-insoluble ingredients and particulate solids within the laundry detergent compositions exhibit a reduced tendency to settle out of the liquid and sediment on the bottom of the container, and more particularly to processes for making the suspendable solid particles.

BACKGROUND OF THE INVENTION

Liquid laundry detergent products offer a number of advantages over dry, powdered or particulate laundry detergent products. Liquid laundry detergent products are readily measurable, speedily dissolved in wash water, non-dusting, are capable of being easily applied in concentrated solutions or dispersions to soiled areas on garments to be laundered and usually occupy less storage space than granular products. Because liquid laundry detergents are usually considered to be more convenient to use than granular laundry detergents, they have found substantial favor with consumers.

However, while liquid laundry detergents have a number of advantages over granular laundry detergent products, there are also disadvantages entailed in using them. In particular, laundry detergent composition components which may be compatible with each other in granular products may tend to interact or react with each other in a liquid, and especially in an aqueous liquid environment. Components such as peroxygen bleaches and bleach precursors can be especially difficult to incorporate into liquid laundry detergent products with an acceptable degree of compositional stability. Poor compositional stability may cause some active ingredients to react with each other prematurely in the product, which can cause physical instabilities such as phase splitting, sedimentation and solidification. This premature reaction may also cause chemical instabilities which can lead to product discoloration or color change, oxygen gas liberation, oxidation of sensitive ingredients (especially enzymes) and, eventually, detersive performance loss.

One approach for enhancing the chemical compatibility and stability of liquid laundry detergent products has been to formulate substantially anhydrous, non-aqueous liquid laundry detergent compositions. Generally, the chemical stability of the components of a non-aqueous liquid laundry detergent composition increases as the amount of water in the laundry detergent composition decreases. Moreover, by minimizing the amount of water in a liquid laundry detergent composition, one can maximize the surfactant activity of the composition. Non-aqueous liquid laundry detergent compositions have been disclosed in Hepworth et al., U.S. Pat. No. 4,615,820, Issued Oct. 17, 1986; Schultz et al., U.S. Pat. No. 4,929,380, Issued May 29, 1990; Schultz et al., U.S. Pat. No. 5,008,031, Issued Apr. 16, 1991; Elder et al., EP-A-030,096, Published Jun. 10, 1981; Hall et al., WO 92/09678, Published Jun. 11, 1992 and Sanderson et al., EP-A-565,017, Published Oct. 13, 1993. See also U.S. Pat. No. 4,889,652, issued Dec. 26, 1989 to Sullivan et al.; U.S. Pat. No. 5,176,173, issued Jan. 5, 1993, to Dixit et al.; U.S. Pat. No. 4,828,723, issued May 9, 1989, to Cao et al. and U.S. Pat. No. 5,589,370, issued Dec. 31, 1996, to Ratuiste et al. for the use of microspheres in detergent compositions.

Fully-formulated detergents typically comprise detersive surfactants, builders and alkalinity sources. However, certain common detergent ingredients such as builders and alkalinity sources are not generally soluble in most non-aqueous solvents. Because these ingredients are typically denser than the liquid matrix of a non-aqueous detergent composition, they have a tendency to separate out of liquid detergent products and form sediments on the bottom of the detergent container between their date of manufacture and their usage by the consumer. This segregation can, in turn, have an adverse effect on product aesthetics, usage instructions, pourability, dispensability, stability and particularly on overall cleaning effectiveness.

Given the foregoing, there is a continuing need to formulate non-aqueous liquid laundry detergent compositions comprising ingredients (e.g. builders, alkalinity sources) which are insoluble in the non-aqueous detergent liquid without the undesirable separation and sedimentation phenomena discussed above. Accordingly, it is a object of the present invention to provide non-aqueous liquid laundry detergent compositions which have excellent cleaning and detersive performance without displaying deleterious separation and segregation phenomena. This is achieved by the present process which converts such high density detergent ingredients into a lower density form which can be stably suspended in a non-aqueous liquid detergent matrix.

SUMMARY OF THE INVENTION

The present invention encompasses a process for reducing the density of dense, particulate, non-surfactant detergent ingredients from their initial density of about 1.7 g/cc, or greater, to a density of about 1.5 g/cc, or less, comprising the steps of:

a) Admixing, and preferably dissolving, said dense ingredients with water, a water-soluble binding agent and, optionally, hollow microspheres, to form a pumpable fluid;

b) dispersing the pumpable fluid from step (a) into a spray-dry tower as droplets; and c) evaporating the water from said droplets by contacting said droplets with hot air, said hot air being at an impinging temperature of at least about 200° C., to form hollow-core (typically, substantially spherical) particles comprising said detergent ingredients.

In one aspect, said dense detergent ingredients which comprise said pumpable fluid are selected from the group consisting of detergency builders, alkalinity sources and mixtures thereof. Preferably, said dense detergent ingredients are selected from the group consisting of water-soluble citrates, carbonates, silicates and mixtures thereof. In another aspect, said pumpable fluid further comprises hollow microspheres, preferably at a weight ratio of said microspheres to said detergent ingredients in the range from about 1:10 to about 1:2, by weight.

Various water-soluble binding agents can be used in the process. Particularly useful is a maleic acid-acrylic acid copolymer, all as disclosed more fully, hereinafter.

In a preferred mode, said pumpable fluid is dispersed as droplets in said spray-dry tower by means of a rotary atomizer, or by means of a pulse dryer, or by means of spray nozzles. Typically, said droplets have a diameter in the range of about 1 micrometer to about 1000 micrometers. Preferably, in step (c) the hot air contacts the falling droplets in a co-current mode.

A highly preferred process herein comprises the steps of:

a) preparing a pumpable fluid comprising water, a binding agent and a water-soluble detersive ingredient selected from the group consisting of citrates, carbonates, silicates and mixtures thereof, at a weight ratio of binding agent: detersive ingredient in the range of about 1:2 to about 1:8, said pumpable fluid optionally comprising water-insoluble, hollow microspheres;

b) dispersing said fluid from step (a) as droplets downwardly into a spray-dry tower by means of a rotary atomizer or pulse dryer while co-currently impinging air at a temperature of from about 210° C. to about 750° C. on said droplets to evaporate said water to form hollow-core, substantially spherical particles comprising said detergent ingredients, said particles having a density in the range of about 0.8 to about 1.2 g/cc.

The invention also encompasses the hollow-core particles per se prepared according to the present process, as well as a process for preparing a fully-formulated non-aqueous liquid detergent, comprising the step of suspending undissolved hollow-core particles made according to the present process in a substantially anhydrous non-aqueous liquid detergent matrix.

The liquid detergent compositions herein comprise a non-aqueous matrix, characterized by the presence of hollow-core, non-surfactant particles prepared as disclosed above, and a non-aqueous liquid carrier. Preferably, said particles have a density of 1.5 g/cc, or less. Most preferably, said particles comprise water-soluble citrates, carbonates, silicates and mixtures thereof. Such compositions typically comprise:

a) from about 30% to about 99.95% by weight of the composition of a surfactant-containing non-aqueous liquid phase; and b) from about 0.05% to about 70% by weight of the composition of suspended solid particles prepared according to the herein-described process.

In a preferred non-aqueous liquid detergent composition, the suspended solid particles comprise by weight:

(a) from about 0% to about 5.0% of microspheres;

(b) from about 1% to about 35% of an alkalinity source;

(c) from about 1% to about 35% of a builder component; and (d) from about 1% to about 35% of binding agents.

It will be appreciated that, while the detergent ingredients which comprise the low density particles herein are not substantially soluble in the non-aqueous liquid detergent matrix in which they are suspended, they dissolve quite readily when the detergent is added to an aqueous laundry liquor.

DETAILED DESCRIPTION OF THE INVENTION

While the process herein can be conducted using otherwise conventional spray-drying equipment, the ingredients and operating conditions are adjusted in such a way as to result in the formation of the desired hollow-core particles, rather than the microporous particles typically formed in the conventional manufacture of spray-dried laundry detergents.

Briefly summarized, the present process is characterized by the selection of ingredients used in the process, e.g.: the builder; the alkalinity source; the binder, which is used at a relatively high ratio; and the absence of surfactant. In addition, in an optional mode, hollow microspheres are employed to provide the core of the hollow-core product of the process. In order to ensure that the drying temperature is correct, it is preferred that the hot, drying air flows co-currently (in the same direction) with the falling droplets in the tower. By contrast, hot air can be introduced counter-currently, but care must be taken that it does not cool too much before contacting the falling droplets. Since the particles prepared by the process have low densities, co-current air flow has the additional advantage that the loss of particles by their being blown out of the top of the spray-drying tower is minimized.

It has further been discovered that non-aqueous liquid laundry detergent compositions can be formulated to contain ingredients with a density (determined by Helium pycnometry) greater than about 1.7 g/cc which are significantly insoluble in the liquid matrix of the detergent composition. These dense ingredients, such as sodium carbonate having an initial density of about 2.5 g/cc and sodium citrate having a density of about 1.8 g/cc, can be suspended successfully in the liquid matrix in two ways:

1. The dense, insoluble ingredients can be used to enrobe water-insoluble low-density, hollow microspheres having a density determined by Helium pycnometry less than about 0.3 g/cc with a coating of one or more of the insoluble ingredients and a binding agent and then suspending the enrobed particle in the non-aqueous liquid detergent composition. Typically the weight ratio of the ingredients which enrobe the microsphere to the microsphere, itself, is in the range of about 1:1 to about 15:1. The enrobed particle thus prepared has a density significantly lower than the density of the ingredients to be suspended and significantly higher than the density of the low-density microsphere itself, typically in the range of about 0.5–1.2 g/cc. The coating ingredients are subsequently solubilized by water when the detergent composition is mixed with water to form a wash liquor, typically in a washing machine. The low-density microspheres themselves are hollow—they do not contain any active detergent ingredient. By enrobing the water-insoluble low-density microspheres with dense ingredients which are insoluble in a nonaqueous liquid detergent, such as builders, alkalinity sources, and a binder, then the latter may be included in a non-aqueous liquid detergent composition while minimizing undesirable segregation and separation. Additionally, the coated low-density microspheres may minimize the segregation and separation of other components of the suspended solid particulate phase (such as bleach and bleach activator particles) which may be present in the compostion.

2. These same ingredients to be suspended which are used for coating water insoluble low-density microspheres can be processed to form hollow-core, low density particles on their own and without the use of water insoluble microspheres to provide the hollow care of the particle. These low density particles have a density, as determined by Helium pycnometry, which is significantly lower than the density of the starting raw materials. As noted above, ingredients having a density above about 1.7 g/cc, such as carbonate and citrate, can have their densities lowered below 1.5 g/cc by the present process. On inspection under magnification (100×–500×) the particles are seen to be substantially spherical in shape. These low density particles are then suspended in the non-aqueous liquid detergent composition and are subsequently solubilized by water when the detergent composition is mixed with water to from a wash liquor, typically in a washing machine. The low-density particles are made with ingredients insoluble in nonaqueous liquid detergents, like polymers, builders and alkalinity sources, and may be included in a non-aqueous liquid detergent composition without resulting in an undesirable segregation and separation. Additionally, these low-density particles may also help minimize the segregation and separation of other components of the suspended solid particulate phase (such as bleach and bleach activator particles), as noted above.

In the compositional aspect of the present invention the liquid detergent compositions are non-aqueous and comprise from about 30% to about 99.95%, preferably from about 56% to about 99.95% by weight of the composition of a surfactant-containing non-aqueous liquid phase and from about 0.05% to about 70%, preferably from about 0.05% to about 44% by weight of the composition of a suspended solid particulate phase. The suspended solid particulate phase comprises the hollow, low-density particles prepared by the present process.

In one embodiment, the present invention encompasses a process for continuously preparing low-density coated microspheres. In the first step of the process, water, coating ingredients and microspheres having an original average particle size of from about 3 μm to about 8 μm are continuously mixed to form an aqueous slurry. Then, the aqueous slurry is heated to an expanding temperature sufficient to cause the microspheres to undergo an expansion of about 2 times to about 10 times the original average particle size. Finally, the aqueous slurry is dried in a spray-dryer so as to form the low-density coated particles wherein the low-density coated particles comprise the hollow-core microspheres substantially enrobed with the coating ingredients.

In an alternate embodiment of a process for preparing low-density coated particles, a mixing step consists of mixing water, coating ingredients and microspheres having an original average particle size of from about 3 μm to about 8 μm to form an aqueous slurry. The aqueous slurry is then dried in a spray-dryer at an expanding temperature sufficient to cause the microspheres to undergo an expansion of about 2 times to about 10 times the original average particle size so as to form the low-density coated particles In yet another embodiment of a process for continuously preparing low-density coated particles, water, coating ingredients and microspheres having an average diameter of from about 15 μm to about 50 μm are continuously mixed to form an aqueous slurry and the aqueous slurry is dried in a spray-dryer so as to form the low-density coated particles wherein the low-density coated particles comprise a microsphere core material, substantially enrobed with the coating ingredients. In this process embodiment, the microspheres are not expanded during drying or mixing and they do not change in size by a significant amount during the process.

Additionally, the present invention also encompasses a granular detergent composition comprising hollow, low-density coated microsphere particles which are substantially enrobed with granulate ingredients. These granulate ingredients may be selected from any of the detersive components taught or disclosed either explicitly or by incorporation by reference in this invention.

In an alternate embodiment of a process for preparing low-density particles, two or more ingredients which are significantly insoluble in the non-aqueous liquid matrix may be processed to form low-density particles without the use of microspheres. At least one of the ingredients is a binding agent significantly insoluble (less than 2% at 30° C.; preferably less than 0.5%; most preferably 0%–0.2%) in the non-aqueous liquid matrix and the other ingredients selected from the group consisting of an alkalinity source, a builder, and mixtures thereof. These low-density particles have the further advantage that, while they are insoluble in the non-aqueous liquid phase, they are completely soluble in water.

The present invention further encompasses a process for continuously preparing low-density particles comprising the steps of continuously mixing water, water-soluble binder and one or more particle ingredients to form an aqueous solution; and then subsequently drying the solution in a spray-dryer to form low-density particles having a substantially spherical shape and a particle size from about 1 μm to 200 μm.

The low-density particles of the present invention may also be used as one of the constituent detergent particles of a granular detergent.

All parts, percentages and ratios used herein are expressed as percent by weight, unless otherwise specified. All documents cited are, in relevant part, incorporated herein by reference. The citation of any document is not to be construed as an admission that the document is prior art against the present invention.

The operational parameters, ingredients, and the like, are disclosed more fully hereinafter.

Definitions—As used herein, "non-aqueous" or "anhydrous" are used synonymously and both describe a fluid in which the water content is less than about 5%, preferably less than abut 1%, typically about 0.2%–1%.

By "encapsulated" and "enrobed" is meant that the coating ingredients described below cover at least a majority of the outer surface of the low-density coated particles.

By "particle size" herein is mean the deameter of the particle at its longest axis. The majority of the particles produced herein are substantially spherical and have a mean particle size in the range of about 1 to about 350 μm (micrometers).

By "mean particle size" is meant the mid-point of the size distribution of the particles made herein, as measured by standard particle size analysis techniques.

By "density" is meant the average density of a sample of powdered material having a particle size range as disclosed above and is obtained by using a Helium pycnometer. The density of liquids can be measured by any conventional densitometer. All densities are measured at ambient temperatures (17° C.–19° C.). "Dense" or "high density" materials herein have a density of about 1.7 g/cc or greater, typically in the range of about 1.7 g/cc to about 2.5 g/cc. The "low density" particles afforded by the present invention have a density below about 1.5 g/cc typically in the range of about 0.5 to about 1.2 g/cc.

By "bulk density" is meant the non-compacted density of a bulk sample of the particles made herein, expressed as kg/l. As is well-known in the detergency arts, this is conveniently measured by determining the mass of particles required to fill a standard 1-liter vessel.

By "impinging temperature" herein is meant the temperature at which the hot air in the spray drying tower contacts the falling droplets to effect evaporation of water therefrom.

By "insoluble" or "significantly insoluble" is meant a solubility less than about 2% in a liquid carrier, such as a non-aqueous liquid detergent composition, at a temperature of 30° C.

By "pumpable" fluid herein is meant any liquid or pasty material whose rheology allows it to be pumped and dispersed in a spray-dry tower.

By "wash-water" or "wash liquor" is meant a mixture of water and the non-aqueous detergent composition herein. This "wash-water" or "wash liquor" is most typically contained in an automatic washing machine, but it may also be contained in a bucket, sink or any other container capable of holding a liquid.

By "molecular weight" of polymers used herein is meant the weight average molecular weight.

Suspended Solid Particulates

In addition to a surfactant-containing liquid phase, the non-aqueous detergent compositions herein preferably comprise from about 0.05% to about 80%, preferably about 0.05% to about 70% by weight, more preferably from about 29% to 44% by weight, of suspended solid material which is dispersed and suspended within the liquid phase.

A. Low-Density Coated Microspheres

An essential component of the liquid detergent compositions of the present invention is the inclusion of low-density particles. In one aspect, the low-density coated particles have a hollow core which is water-insoluble and the core is enrobed by coating materials (described in greater detail below). Ingredients which are insoluble in a non-aqueous liquid detergent composition may be added to the detergent composition by enrobing a water-insoluble core particle with a coating of insoluble ingredients and then suspending the particle in the liquid matrix of the non-aqueous detergent composition. By adding these insoluble materials in this way, segregation and sedimentation of these insoluble materials may be minimized. Additionally, when the low-density coated particles are incorporated into a laundry detergent composition which contains other particulate solids, the low-density coated particles reduce the tendency of the other particulate solids to separate or settle out of the laundry detergent composition. The addition of the low-density particles also acts to decrease the overall density of the liquid detergent composition.

Suitable microspheres may be made of one or more water-insoluble materials selected from the group consisting of: polymers; silicaceous materials; ceramics and mixtures thereof. For further discussion of microspheres, see "Microencapsulation" in Kirk-Othmer Encyclopedia of Chemical Technology, Third Edition, Volume 16, pages 628–651 (John Wiley & Sons, Inc., 1979.

Polymer microspheres of the present invention are preferably made of a water-insoluble material selected from the group consisting of: thermoplastics; acrylonitrile; methacrylonitrile; polyacrylonitrile; polymethacrylonitrile and mixtures thereof. Silicaceous microspheres of the present invention are preferably made of one or more silicaceous materials selected from the group consisting of glass.

In one embodiment of the invention it is preferable that the low-density coated microspheres be produced using low density microspheres in their expanded form before being added to the aqueous solution which contains the coating ingredients described below. Examples of these microspheres in their expanded form are EXPANCEL®$^{WE\ and}$ EXPANCEL® $^{DE}$, available from Akzo-Nobel of Sweden and Q-CEL® hollow spheres products available from PQ Corporation.

In another embodiment it is desirable that the low-density coated microspheres be produced using unexpanded microspheres containing liquid or gas expanding or blowing agents. Examples of this is EXPANCEL® $^{WU\ and}$ is EXPANCEL® $^{DU}$ These agents allow the microspheres of the present invention to be expanded in situ in a spray dryer in the process of spray drying a slurry of which the microspheres are one constituent, along with the coating ingredients described below. The expanding agent can be selected from the group consisting of liquid or gaseous hydrocarbons, gases, and mixtures thereof. Suitable liquid hydrocarbons are liquid hydrocarbons that are vaporizable at a temperature lower than the softening point of the microsphere material. Examples include, but are not limited to, propane, propylene, butene, n-butane, isobutane, isopentane, neopentane, n-pentane, hexane, heptane, petroleum ether, halogenized methane, tetraalkylsilane and the like. In addition to the liquid hydrocarbons, which may be in gas form depending upon the temperature, the expanding agents may also be selected from the group consisting of nitrogen, carbon dioxide, oxygen, and mixtures thereof. Preferably, the expanding agent is isobutane. Further materials and compounds suitable for use herein can be found in U.S. Pat. No. 5,205,290, issued Mar. 23, 1976, to Unger; U.S. Pat. No. 3,945,956, issued Mar. 23, 1976, to Garner.

Commercially available microspheres are available from Akzo-Nobel of Sweden under the trademark EXPANCEL®; PQ Corp. under the trade names PM 6545, PM 6550, PM 7220, PM 7228, EXTENDOSPHERES®, LUXSIL®, Q-CEL®, SPHERICEL®; and Malinckrodt under the trademark ALBUMEX®.

For this invention, the most preferred are microspheres which, when in their expanded form, have a density as determined by Helium pycnometry lower than about 0.3 g/cc typically 0.1–0.28 g/cc.

B. Low-Density Particles

The suspended solid particulates may also be in the form of hollow-core low-density particles, which are not the enrobed microspheres discussed above These low-density particles are formed by a spray drying process conducted in such a way that the resulting dried particles are completely or partially hollow. When incorporated into the non-aqueous liquid detergent compositions of the present invention, such low-density particles also reduce the tendency of other solid particulate ingredients to separate out of the laundry detergent composition and form a sediment layer on the bottom of the detergent composition container.

Without being limited by theory, there are at least two proposed explanations for how the suspended particles accomplished these benefits. A first explanation for the benefits provided by the low-density particles is that they provide a counteracting resistance to the sedimentation of the adjuvant particles. As the adjuvant particles flow downward at a rate governed by Stokes' Law they come into physical contact with the low-density particles which impede their further downward movement until the adjuvant particles can migrate around the outer surface of the low-density particles. Thus, the low-density particles form an obstacle field which considerably reduces the rate of sedimentation of the adjuvant particles. The detailed path that individual adjuvant particles take through this obstacle field may be calculated using an analysis based on Brownian Motion or Ising Model calculations.

Still another explanation is that a sufficient amount of the low-density particle is added to the liquid phase so that the mean, statistically weighted densities of the adjuvant particles and the low-density (when taken together) is approximately the same as the density of the liquid phase. Essentially, this means that the density of all of the suspended solid particle phase is matched with the density of the liquid phase. Thus as the rate of sedimentation is directly proportional to the difference in densities between the liquid and the suspended solid phase (Stokes' Law), the rate of sedimentation is considerably reduced.

The low-density particles of the present invention are preferably constructed from material which is insoluble in the non-aqueous surfactant-rich liquid phase of the present invention but soluble in water. The low-density particles are preferably partially or completely hollow particles formed through the spray-drying processes described below.

The ingredients from which the low-density particles of the present invention are made include: organic and inorganic builder material, alkalinity source material and other particle ingredient components such as polymers, binding agents and chelants.

C. Ingredients Used for Coating Microspheres or for Producing Low Density Particles:

(a) Inorganic and Organic Builder Material

Builder material which serves to counteract the effects of calcium, or other ion, water hardness encountered during laundering/bleaching use of the compositions herein can form part of the coating on the low-density coated particles. Examples of such materials include the alkali metal citrates, succinates, malonates, fatty acids, carboxymethyl succinates, and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the DEQUEST™ tradename and alkanehydroxy phosphonates. Citrate salts are highly preferred.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6® is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5®, NaSKS-7® and NaSKS-11®, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

If utilized as all or part of the suspended particulate solid, insoluble organic detergent builders can generally comprise from about 1% to 20% by weight of the total non-aqueous liquid detergent compositions herein.

(b) Alkalinity Sources

A further material which can form part of the low-density particles is a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Water-soluble phosphate salts may also be utilized as alkalinity sources. These include alkali metal pyrophosphates, orthophosphates, polyphosphates and phosphonates. Of all of these alkalinity sources, alkali metal carbonates and silicates such as sodium carbonate and sodium silicate are the most preferred.

Of course, it will be appreciated by those skilled in the art that certain builder materials also provide alkalinity, and certain alkalinity sources also have builder properties. Accordingly, the term "mixtures" as used herein includes both mixtures of two separate ingredients, as well as single ingredients with such dual properties.

If utilized as all or part of the suspended particulate solid phase, the alkalinity source will generally comprise from about 1% to 25% by weight of the total non-aqueous liquid detergent compositions herein. Such materials, while water-soluble, will generally be insoluble in the non-aqueous detergent compositions herein.

(c) Binding Agents:

The low-density particles may also comprise other non-surfactant particle ingredient components which serve both functionally detersive and structural purposes. In particular, a desirable structural ingredient is a water soluble binding agent. Alkylene aminomethylene phosphonic acids or water soluble salts thereof which can serve as an binding agent to hold together the above-noted, non-surfactant ingredients.

As is discussed elsewhere in this application, these acids and their corresponding salts can also serve as a chelant which serves to chelate metal ions, e.g., iron and/or manganese, within the detergent compositions herein. Useful chelating agents can include amino carboxylates, phosphonates, amino phosphonates, polyfunctionally-substituted aromatic chelating agents and mixtures thereof.

Amino carboxylates, optionally also useful as binding agents, include ethylenediaminetetraacetates, N-hydroxyethyl-ethylenediaminetriacetates, nitrilotriacetates, ethylene-diamine tetrapropionates, triethylenetetraaminehexacetates, diethylenetriaminepentaacetates, ethylenediaminedisuccinates and ethanol diglycines. The alkali metal salts of these materials are preferred.

Other such agents include hydroxy-ethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. A preferred example of the chelant is Diethylene Triamine Penta Methyl Phosphonic Acid (DTMPA) which is available commercially under the name DEQUEST™ Grade 2066 from the Monsanto Company.

Especially useful binding agents include polymeric compounds such as water soluble maleic/acrylic copolymers (particularly a 40% maleic/60% acrylic blend), water soluble polyacrylates of molecular weights from about 2000 to about 5000 (particularly molecular weights of around 4500).

Also suitable are organic polymers such as polyethylene glycol with a molecular weight of between 1000 and 6000 and polyvinylpyrolidone, particularly crosslinked polyvinylpyrolidone such as those sold under the trade name POLYPLASDONE XL™ or KOLLIDON CL.™

Such binding agents will generally comprise from about 0.1% to 25% by weight of the low density particles herein.

The above materials can also serve as desiccants, moisture sinks or water scavengers when used in the non-aqueous liquid detergent. Of all these binding agents, the sodium salts of maleic/acrylic copolymers are the most preferred.

Method for Making Coated Microspheres

One present process for preparing the low-density coated microspheres is as follows. The water-insoluble microspheres are coated with the materials disclosed above in a heat expansion process. In the mixing step, the process entails continuously mixing and heating an aqueous mixture containing the water-soluble coating ingredients to form a solution. The water-insoluble microspheres (such as EXPANCEL™), as well as the coating ingredients discussed above, are then added to the solution in the mixer to form a slurry. The concentration of water soluble components in this slurry is less than 70%, preferably less than 60%, more preferably less than 50%, typically 20%–40%. A preferable slurry composition is one in which the slurry has sufficient amounts of the water-soluble and water-insoluble components so that the final low-density coated particulate product will comprise from about 1% to about 15% of microspheres, from about 1% to about 95% of an alkalinity source, from about 5% to about 95% of a builder component, and from about 1% to about 95% of binding agents. When initially added to the aqueous solution, the microspheres are unexpanded and have an average diameter of from about 3 $\mu$m to about 15 $\mu$m. However, during the mixing the solution is heated to a temperature sufficient to cause the microspheres in the aqueous solution to increase from their original size to about two to ten times their original size. While the proper temperature to cause the expansion is dependent on the type of microsphere being used, the temperature is preferably between about 60° C. to about 120° C.

A suitable mixer for the mixing process step is one consisting essentially of a horizontal, hollow static cylinder having a centrally mounted rotating shaft with a suitable impeller stirrer.

The aqueous mixture, which results from the mixing step, is then fed to a spray-tower. One or more spray drying techniques in one or more spray-drying towers may be used to make detergent compositions in accordance with the instant invention. The aqueous mixture is fed into the spray dryer and spray dried to form a coating of the dried coating ingredients which substantially enrobes the outer surface of the microspheres, thus forming a low-density coated particle. Spray drying equipment is discussed in K. Masters, *Spray Drying Handbook 5th Edition*, Longman, N.Y.

The process of forming a low-density coated particle may also be practiced in a second, more preferred, embodiment. In the mixing step of this embodiment, a microsphere-containing mixture is formed as described above. However, in this second embodiment, the mixture is heated only to a temperature sufficient to solubilize the coating ingredients in the aqueous mixture, preferably 40–60 C, and the microspheres retain their unexpanded shape and size. The mixture is then fed to the spray-tower where it is dispensed into the spray-tower and under at the elevated temperatures of operating the spray dryer the coating ingredients dry while the elevated temperature causes the microspheres to expand from their original size to up to ten times their original size. Thus produced is a low-density coated particle with a coating of dried coating ingredients which encapsulates the outer surface of an inner core microsphere. In both the first and second embodiments and depending on the dryer and the drying technique, the inlet air temperature which impinges on the falling droplets in the tower can range from preferably from at least about 200° C. to about 300° C. in a conventional spray dryer with a rotary atomizer and from about 500° C. to about 750° C. in a pulse dryer. The outlet temperature should be controlled to be from about 100° C. to about 150° C. in all cases. In this second embodiment, it is important that the spray drying conditions be controlled and monitored so that the kinetics of expanding the microspheres are faster than the kinetics of drying the film around the microspheres; if the kinetics are not so properly controlled, a hard shell may be prematurely formed around the microspheres which would prevent the microspheres from expanding fully to their desired size, hence producing a relatively more dense particle.

If microspheres are selected for use in either of the first or second process embodiments, such microspheres must be the type of microspheres that expand upon the application of heat, such as the EXPANCEL™ type of polymeric microspheres. Other microspheres, like the borosilicate microspheres of the Q-CEL™ type, are not expandable upon heating and are thus not suitable for use in either of the first or second process embodiments.

The process may also be practiced in yet a third embodiment, in which the size of the microsphere does not change by a significant amount upon heating. (By "significant amount" it is meant that the change in size is not greater than 75% of its pre-processed size.) Thus borosilicate microspheres which do not expand upon heating are suitable for use, as are polymeric microspheres which may be purchased in their already expanded state; for example, Q-Cel™ microspheres with an particle size ranging from 5–200 μm are widely available from the PQ Corporation.

In the first step of this third embodiment, an aqueous mixture of the coating ingredients and expanded Q-Cel™ microspheres having an average particle size of from about 5 μm to about 130 μm is prepared. The mixture is heated only to a temperature sufficient to solubilize the coating ingredients in the aqueous mixture, typically 40–50 deg C. as in the second embodiment. In this third embodiment the spray-dryer is operated so that the air inlet temperature is most preferably 200–300 C and an outlet temperature of from about 100° C. to about 150° C.

The resulting aqueous mixture is then fed to a spray-tower where, as described above, it is spray dried to form a coating which substantially enrobes the outer surface of the microspheres, thus forming a low-density coated microsphere.

At the conclusion of any of the above process embodiments the low-density coated particles will be characterized by the following physical characteristics: a size distribution with a preferred particle size range from about 7 μm to-about 250 μm; a density range of less than 1.5 g/cc, preferably less than about 1.2 g/cc, more preferably less than about 1.0 g/cc; a bulk density of less than about 700 grams/liter, typically about 200–650 g/l; and a moisture less than 5%, preferably less than 3%, more preferably less than 2%.

The low-density coated microsphere particles and the processes for producing them which are provided by the present invention may also be used in the manufacture of granular detergent products. After the low-density microspheres are formed by any of the process embodiments described above, they may be mixed with other detergent particles and/or dried detergent agglomerates to form a granular detergent product. The other detergent components as well as the processes for mixing, agglomerating and drying are all-well known to those skilled in the art. Low-density coated particles which are intended to be used as spray-dried particles in the manufacture of a granular detergent composition may be coated with a broader variety of ingredients than those described above which are added to a non-aqueous liquid detergent composition; thus ingredients to coat the particle may be selected from any of the detersive components taught or disclosed either explicitly or by incorporation by reference in this invention. Most preferably the coating ingredients for the coated low-density particles are selected from polymers, chelants, hydrotropes, fillers, and other ingredients usually used in crutcher mixes, other than surfactants.

Method Aspect for Making Low Density Particles Without Microspheres

The present invention also provides a preferred process for preparing the low-density, "non-coated" particles of the present invention without the use of water insoluble microspheres.

In a first aspect, the first step of the process entails making an aqueous solution by continuously mixing and optionally heating a mixture of water, the water-soluble binder, as well as one or more particle ingredients in a mixer. These particle ingredients will form the shell of the low-density particle, which is ultimately formed as a hollow, typically substantially spherical, non-coated particle having a size range, density and bulk density range as noted above for the coated particles. The particle ingredients are added to the aqueous solution in sufficient amounts so that the final low-density particulate product will comprise from about 1% to about 95% of an alkalinity source, from about 1% to about 95% of a builder component and from about 1% to about 95% of binding agents and other low-density particle ingredient components (e.g. chelants and polymers). The aqueous solution will comprise less than 70%, preferably less than 60% and more preferably less than 50%, typically 10%–40%, water.

A suitable mixer for this process step is one consisting essentially of a horizontal, hollow static cylinder having a centrally mounted rotating shaft and a suitable impeller.

The aqueous solution is then fed into the heated chamber of a spray-tower where it is dried to form the low-density particles. The low-density particles are dried in such a way that they are completely or partially hollow at the core (i.e. voids or cavities are formed inside). Completely or partially hollow particles are believed to be formed by one of four separate mechanisms:

(a) A droplet of the solution-slurry is first formed and then a surface layer, semi-impervious to vapor flow, forms at the droplet surface. As vapor is formed within the droplet and expands with the increase in droplet temperature a microsphere is formed. Typically, because of their high surface area, spherical spray-dried particles are rapidly converted in the spray-drying process by evaporation of the water solvent into a fine powder.

(b) Moisture evaporates at a rate faster than the diffusion of solids back into the droplet's interior. On completion of evaporation, air voids are present, especially in the case of crystalline products.

(c) Liquid flows with accompanying solids to the droplet surface by capillary action, leaving the center of the droplet as a void.

(d) Air trapped in the solution-slurry contributes to air spaces within the droplet.

One or more spray drying techniques in one or more spray-drying towers may be used to make detergent compositions in accordance with the instant invention. Many suitable spray drying techniques and spray drying equipment are discussed by K. Masters, cited above. It is preferred that the process be carried out using a rotary-disk atomizer and a co-current flow spray dryer. In the spray-drying process the inlet temperature of the impinging air in the spray-dryer is preferably from about 200° C. to about 400° C. and the outlet temperature is from about 100° C. to about 160° C.

Another drying process useful in accordance with the methods of the present invention is a pulse drying process. Pulse drying is a form of spray-drying which comprises introducing droplets of the material to be dried, such as the aqueous solution of the present invention, into heated, flowing, drying air in the presence of acoustic energy to significantly reduce the moisture content of the substance being processed. Nonlimiting examples of pulse drying processes are described in U.S. Pat. No. 4,226,668 issued Oct. 7, 1980 to F. A. Ferguson, U.S. Pat. No. 4,859,248 issued Aug. 22, 1989 to Thaler et al., and in "Pulse Combustion Lowers Drying Costs" (Chemical Engineering, Dec. 10, 1984 pp. 44–45). A pulse drying process generally comprises a cyclical pattern of detonations, which preferably occur at about 250 times per second, which provide a high energy, broad-band, accoustic wave front. This sonic energy causes rapid, efficient dispersion of the fluid feedstock, such that no rotary atomizer is required, as well as dispersion of the low-density particles. Also, the sonic waves are thought to "vibrate" each low-density particle, facilitating heat and mass transfer. Although the impinging temperature of the hot jet gases used to produce the pulses can reach 1371° C. in temperature, residence time in this turbulent zone is very short, only several milliseconds, so that the actual system temperature of the low-density particles is preferably much lower—about 149° C. (300° F.) maximum. It is the combination of high thermal and sonic energy which, encourages efficient heat transfer, and, thus, provides the physical environment for drying the low-density particles.

In this preferred embodiment, the low-density particles have a particle size distribution range of from about 1 μm to about 150 μm and a density range of less than 1.5 g/cc, preferably less than 1.2 g/cc, more preferably less than 1.0 g/cc, typically 0.3 g/cc to about 0.9 g/cc.

The low-density particles and the processes for producing them which are disclosed in the present invention can also be used in the manufacture of granular detergent products in the same manner disclosed above for the enrobed particles having the microsphere cores.

Detergent Compositions Comprising Low-Density Particles

The low-density particles of the present invention are preferably incorporated into detergent compositions, more preferably liquid detergent compositions, most preferably non-aqueous liquid detergent compositions. Such substantially anhydrous (less than 5% moisture; dispersed expanded microspheres EXPANCEL™ 091DE are based on the same process conditions as in Example 2. The composition of the dried powders are given below.

| Sodium Carbonate | Sodium Citrate | Sokalan CP5 | EXPANCEL ™ 091DE | % Moisture Bottom sample | % Moisture Cyclone sample | Density (g/cc) Bottom sample | Density (g/cc) Cyclone sample |
|---|---|---|---|---|---|---|---|
| 18.07 | 60.24 | 18.07 | 3.61 | 1.39 | 0.68 | 0.5 | 0.91 |
| 17.14 | 57.14 | 17.14 | 8.57 | — | — | 0.45 | 0.69 |

EXAMPLES 5–7

Examples 5–7 are based on using an industrial scale spray dryer made by Niro, Denmark. The conical spray dryer is about 12 ft in diameter, fitted with a rotary atomizer and an atomizer wheel. The air is supplied from the top of the dryer co-currently with the liquid to be dried.

Example 5: In this example, an atomizing wheel, 247 mm in diameter with 16 curved vanes, supplied by Niro, is operated at 15,000 rpm. In a heated stirred tank, a 40% aqueous solution is prepared by mixing water, sodium carbonate, sodium citrate dihydrate, and Sokalan CP5™. The solution temperature is kept between 40–6° C. to ensure total solubility of the salts. The co-current air inlet temperature is kept between 210–215° C. while keeping the outlet air temperature between 95–105° C. Dried product is extracted from the bottom of the drying chamber and conveyed to a cyclone where the majority of the product is discharged through a rotary valve at the bottom. A minimal amount of fine product is entrained in the exhaust air from the cyclone and can be recovered.The composition of the dried powder is the same composition used in Example 1, run # a. The moisture and density of the dried powder collected from the cyclone are as follows:

| Inlet Air Temperature (deg C.) | Outlet Air Temperature (deg C.) | % Moisture | Density (g/cc) | Bulk Density (g/litre) |
|---|---|---|---|---|
| 213 | 99 | 1.2 | 1.0654 | 535 |
| 208 | 104 | 1.5 | 1.0873 | 531 |

Example 6: A FloMax FM 10 two fluid nozzle supplied by Spraying Systems Company USA is installed in place of the atomizing system. In a heated stirred tank, an aqueous solution is prepared by mixing water, sodium carbonate, sodium citrate dihydrate, and Sokalan CP5™. The solution temperature is kept between 40–60 C to ensure total solubility of the salts. The liquid is pumped to the top of the spray dryer into the two fluid nozzle. Ambient air is supplied at 65SCFM to the two fluid nozzle for atomization. The dryer is operated in a co-current mode. Both the co-current air inlet temperature the exit air temperature are varied as well as the concentration of the liquid. Dried product is conveyed from the bottom of the drying chamber to a baghouse and was discharged through a rotary valve. The resulting composition of the dried powder is the same composition used in Example 1, run #1a. The moisture and density of the dried powder collected from the cyclone are as follows:

| Liquid Concentration (%) | Inlet Air Temperature (deg C.) | Outlet Air Temperature (deg C.) | % Moisture | Density (g/cc) | Bulk Density (g/litre) |
|---|---|---|---|---|---|
| 40 | 269 | 116 | 0.7 | 1.1118 | 380 |
| 40 | 216 | 109 | 1.3 | 0.9036 | 430 |
| 20 | 215 | 110 | 1.5 | 0.9272 | 403 |
| 20 | 274 | 105 | 1.1 | 0.8959 | 412 |

Example 7: In this example, the atomization system is changed from an atomizing wheel to a two fluid nozzle. Specifically, a FloMax FM10 two fluid nozzle supplied by Spraying Systems Company, USA was installed in place of the atomizing system. In a heated stirred tank, 40% aqueous solution was prepared by mixing water, sodium citrate dihydrate, and Sokalan CP5™. The solution temperature was kept between 40–60 C to ensure total solubility of the salts. The liquid was pumped to the top of the dryer into the two fluid nozzle. Ambient air is supplied to the two fluid nozzle for atomization at the nozzle's maximum flow rate design for air flow. The dryer is operated in a co-current mode. Dried product is conveyed from the bottom of the drying chamber to a baghouse and is discharged through a rotary valve from the bottom of the baghouse into big bags. The resulting composition of the dried powder is the same composition used in Example 1, run #1c. The moisture and density of the dried powder collected from the cyclone are evaluated and the results are tabulated as follows:

| Inlet Air Temperature (deg C.) | Outlet Air Temperature (deg C.) | % Moisture | Density (g/cc) | Bulk Density (g/litre) |
|---|---|---|---|---|
| 216 | 117 | 1.2 | 0.7251 | 231 |
| 179 | 0.8204 | | | 37.25 |
| 286 | | 0.8738 | | 35.32 |
| 275 | | 0.8712 | | 33.64 |
| 285 | | 0.8600 | | 38.23 |
| 326 | | | 0.9018 | 32.39 |
| 386 | | | 0.9419 | 38.55 |

Example 12: This example is based on using an industrial scale spray dryer made by Niro, Denmark. The spray dryer is about 10 meters in diameter and is fitted with a Niro rotary atomizer and a Niro atomizer wheel 210 mm in diameter with 36 straight rectangular vanes that operate at about 17,500 rpm. In a heated stirred tank, 40% aqueous solution is prepared by mixing water, sodium carbonate, sodium citrate dihydrate, and Sokalan CP5™. The solution temperature is kept between 40–60 C. The solution is pumped to the rotary atomizer placed centrally in the air disperser at the top of the drying chamber. The wheel operated by the atomizer creates a spray of droplets. The spray-tower is operated with a co-current stream of hot air, an inlet temperature of approximately 200–220° C. and an outlet temperature of approximately 105–110° C. The volume of air used for drying is varied and is expressed in the table below as the amperage draw of the fan. Dried product is conveyed from the side of the dryer to a bag house which is pulsed periodically to allow for product collection through a rotary valve at a rate of 3 tons/hr.

The composition of the dried powder is the same composition used in Example 1. The moisture and density of the dried powder collected from the bag house are tabulated as follows:

| Air Fan Speed (Amps) | Mean Particle Size (microns) | % Moisture | Density (g/cc) | Bulk Density (kg/l) |
|---|---|---|---|---|
| 155 | 56 | 1.28 | 1.0584 | 0.323 |
| 205 | 53 | 1.59 | 0.9271 | 0.336 |
| 230 | 50 | 1.5 | 0.8736 | 0.342 |

EXAMPLE 13

Example 13: This example is based on a pulse dryer made by J. Jireh Corporation, U.S.A. The drying chamber is about 1 meter in diameter and about 3.35 meters in length and is fitted with a two fluid nozzle also designed and supplied by the same company.

In a heated stirred tank, a 40% aqueous solution is prepared by mixing water, sodium carbonate, sodium citrate dihydrate, and Sokalan CP5™. The solution temperature is kept between 40–60 C. The co-current air inlet temperature is varied while keeping the product outlet temperature constant at 107 deg C. Dried product is extracted from the bottom of the drying chamber and conveyed to a cyclone where the majority of the product is discharged through a rotary valve. A minimal amount of fine product is entrained in the exhaust air from the cyclone and can be recovered in the bag house. Dried product is conveyed from the bottom of the drying chamber and conveyed to a cyclone where the majority of the product is discharged through a rotary valve from the bottom of the cyclone. A minimal amount of fine product is entrained in the exhaust air from the cyclone and recovered in the bag house. The composition of the dried powder is the same composition used in Example 1, run #a. The moisture and density of the dried powder collected from the cyclone are tabulated as follows:

| Inlet Pulsed Air Temperature (deg C) | Outlet Air Temperature (deg C) | % Moisture | Density (g/cc) | Mean Particle Size (microns) |
|---|---|---|---|---|
| 710 | 121 | 5.60 | 0.962 | 51 |
| | 110 | 4.58 | 0.9719 | 59 |
| 593 | 107 | 5.3 | 0.9596 | 67 |

EXAMPLE 14

Example 14: Particles made according to the present invention in Example 12, having a density of 0.8736 g/cc, are used as a component in the following non-aqueous liquid detergent composition with BPP as a carrier liquid.

| Component | Wt % |
|---|---|
| Na LAS | 15 |
| Nonionic Surfactant[1] | 20 |
| n-BPP | 17.55 |
| Hydrotrope[2] | 4.74 |
| Phosphonate[3] | 2.85 |
| $Na_3$EDDS | 1.15 |
| Ethoxylated Quaternized amine clay material | 1.23 |

What is claimed is:

1. A process for reducing the density of dense, particulate, non-surfactant detergent ingredients from their initial density of about 1.7 g/cc, or greater, to a density of about 1.5 g/cc, or less, comprising the steps of:

a) admixing said dense ingredients with water, a water-soluble binding agent and water-insoluble hollow microspheres, at a weight radio of said detergent ingredients: said microspheres in the range from about 1:10 to about 1:2, to form a pumpable fluid;

b) dispersing the pumpable fluid from step (a) into a spray-dry tower as droplets; and c) evaporating the water from said droplets by contacting said droplets with hot air, said hot air being at an impinging temperature of at least about 200° C., to form hollow-core particles comprising said detergent ingredients coated on said microspheres.

2. A process according to claim 1, wherein said dense detergent ingredients which comprise said pumpable fluid are selected from the group consisting of detergency builders, alkalinity sources and mixtures thereof.

3. A process according to claim 2, wherein said dense detergent ingredients which comprise said pumpable fluid are selected from the group consisting of water-soluble citrates, carbonates, silicates and mixtures thereof.

4. A process according to claim 1, wherein said water-soluble binding agent is a maleic acid-acrylic acid copolymer.

5. A process according to claim 1, wherein said pumpable fluid is dispersed as droplets in said spray-dry tower by means of a rotary atomizer, or a pulse dryer, or spray nozzles.

6. A process according to claim 4, wherein said droplets have a diameter in the range of about 1 micrometer to about 1000 micrometers.

7. A process according to claim 1, wherein in step (c) the hot air contacts said droplets in a co-current mode.

8. A process according to claim 1 comprising the steps of:

a) preparing a pumpable fluid comprising water, a binding agent and a water-soluble detersive ingredient selected from the group consisting of citrates, carbonates, silicates and mixtures thereof, at a weight ratio of binding agent: detersive ingredient in the range of about 1:2 to about 1:8, said pumpable fluid comprising hollow, water-soluble microspheres;

b) dispersing said fluid from step (a) as droplets downwardly into a spray-dry tower by means of a rotary atomizer, pulse dryer, or spray nozzles, while co-currently impinging air at a temperature of from about 210° C. to about 750° C. on said droplets to evaporate said water to form hollow-core, substantially spherical particles comprising said detergent ingredients, said particles having a density in the range of about 0.5 to about 1.2 g/cc.

9. A process for preparing a fully-formulated non-aqueous liquid detergent, comprising the step of suspending undissolved hollow-core particles made according to claim 1 in a substantially anhydrous, non-aqueous density-matched liquid detergent matrix.

10. A non-aqueous liquid detergent composition comprising:

a) from about 30% to about 99.95% by weight of the composition of a surfactant-containing non-aqueous liquid phase; and b) from about 0.05% to about 70% by weight of the composition of suspended solid particles prepared according to claim 1.

11. A non-aqueous liquid detergent composition according to claim 10 wherein the suspended solid particles comprise, by weight a mixtures of ingredients comprising:

(a) from about 1% to about 35% of an alkalinity source;

(b) from about 1% to about 35% of a builder component; and (c) from about 1% to about 35% of binding agents, said particles additionally comprising, (d) water-insoluble hollow microspheres at a weight ratio of said microspheres to said detergent ingredients in the range from about 1:10 to about 1:2, said detergent ingredients being coated on said microspheres.

* * * * *